United States Patent [19]

Frank

[11] Patent Number: 4,507,629

[45] Date of Patent: Mar. 26, 1985

[54] MICROWAVE PHASE SHIFTER

[76] Inventor: Gilbert H. Frank, Clarksville, Md.

[21] Appl. No.: 471,089

[22] Filed: Mar. 1, 1983

[51] Int. Cl.[3] ..... H01P 1/18

[52] U.S. Cl. ..... 333/164; 333/1.1; 333/157; 333/262

[58] Field of Search ..... 333/156–158, 333/160–161, 164, 1.1, 247, 262, 263; 328/155; 343/767, 777, 778; 307/300, 320

[56] References Cited

U.S. PATENT DOCUMENTS

| | | | |
|---|---|---|---|
| 3,423,699 | 1/1969 | Hines | 333/164 |
| 3,448,414 | 6/1939 | Brunton | 307/320 X |
| 3,656,069 | 4/1972 | Beccone et al. | 333/156 |
| 3,718,873 | 2/1973 | Garver | 333/164 |
| 3,803,625 | 4/1974 | Nemit | 343/778 X |

OTHER PUBLICATIONS

White-"Diode Phase Shifters for Array Antennas", Reprint from IEEE Trans. on Microwave Theory and Techniques, vol. MTT-22, No. 6, Jun. 1974; Title Page, pp. 1–17.

*Primary Examiner*—Marvin L. Nussbaum
*Attorney, Agent, or Firm*—J. B. Hinson

[57] ABSTRACT

A phase shifter utilizing a circulator and electronic switches to change the length of a transmission line is disclosed. More specifically, a section of transmission line terminated in a short circuit is coupled to one port of a circulator. Energy exiting the port is reflected by the short circuited transmission line to introduce a phase delay in the signal. A PIN diode is utilized to provide a switchable short across the transmission line to reduce its electrical length thereby reducing the phase delay.

2 Claims, 5 Drawing Figures

MICROWAVE PHASE SHIFTER

STATEMENT OF GOVERNMENT INTEREST

This invention was either first conceived or reduced to practice under a Contract No. F33657-81-C-0115 with the U.S. Government.

BACKGROUND OF THE INVENTION

1. Field of the Invention

The invention relates to microwave devices and more specifically to phase shifters utilizing PIN diodes.

2. Description of the Prior Art

It is well known in the art that microwave switching devices such as PIN diodes were difficult to turn off rapidly. This resulted in increased dissipation during the turn-off time. This feature limited the applications of these devices to environments where the dissipation could be limited during the switching transients or to the use of thicker "I" region diodes which limit switching speed.

SUMMARY OF THE INVENTION

The phase shifter which is the subject of this invention substantially improves the power handling capabilities of phase shifters using PIN diode switches by providing an improved method and circuitry for rapidly switching the diodes on and off, therefore reducing the dissipation during forward to reverse and reverse to forward transition. More specifically, the invention provides pin diode phase shifter which uses a driver circuit in which the diodes are turned on rapidly by providing them with a fast rise time substantially constant current pulse. During turn-off, a short current pulse is provided to rapidly turn the diode off followed by a voltage bias signal to maintain the diodes in the off position.

DESCRIPTION OF THE PREFERRED EMBODIMENT

Figure 1:
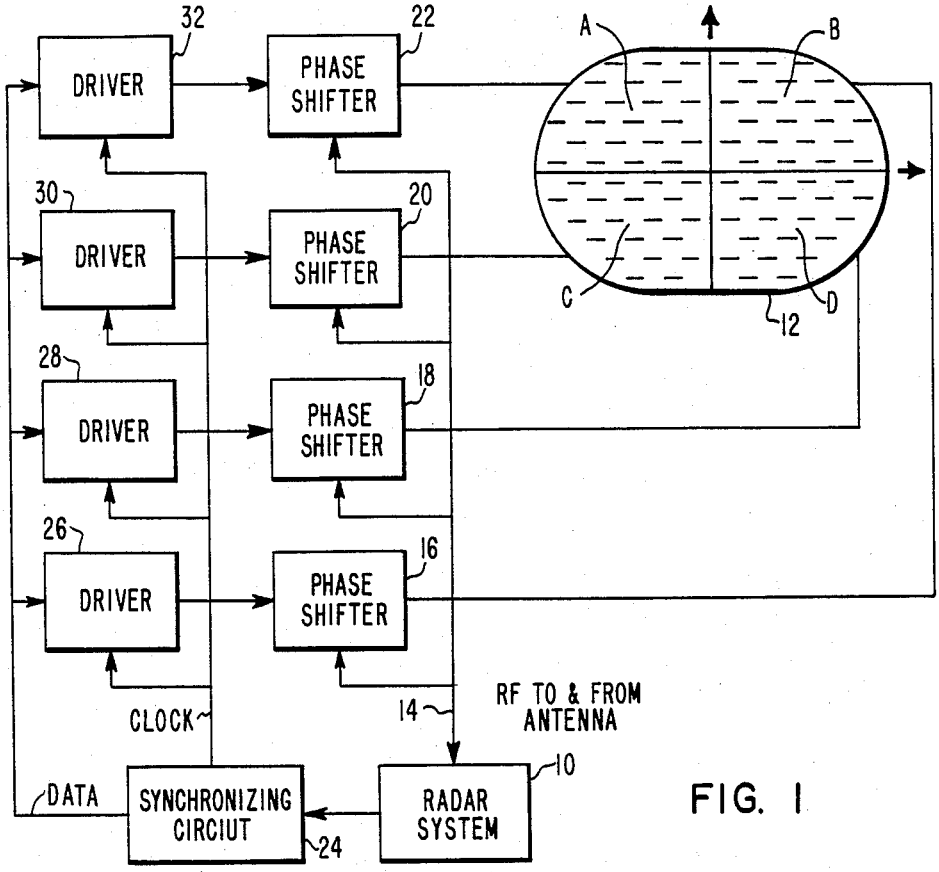
FIG. 1 is a block diagram of a radar system illustrating the use of the phase shifters comprising the invention.

FIG. 1 is a block diagram of a radar system utilizing the phase shifters comprising the preferred embodiment of the invention. Microwave energy to and from the radar system 10 is coupled to a slotted waveguide antenna 12 by a transmission line 14 such as a conventional waveguide, for example, through four substantially identical phase shifter circuits 16, 18, 20 and 22. Each of the phase shifter circuits 16 through 22 are coupled to an individual segment of the segmented slotted waveguide antenna 12 with the segments being labelled A, B, C and D.

Radar system 10 also provides a timing signal to a synchronizing circuit 24. This circuit generates a four-bit data signal with the individual bits of this signal coupled to four individual driver circuits 26, 28, 30 and 32. Synchronizing circuit 24 also generates a clock signal which is coupled to the drivers 26–32 to generate bias signals which are coupled to the phase shifters 16, 18, 20 and 22 to turn on and off diodes (preferably pin diodes) which are coupled across a section of waveguide to change the electrical length of the waveguide. This change in the electrical length of the waveguide in conjunction with a conventional circulator permits a fixed (receive only) phase delay to be introduced into the RF path to segments A, B, C and D of antenna 12, depending on the data signal from the synchronizing circuit 24.

Figure 2:
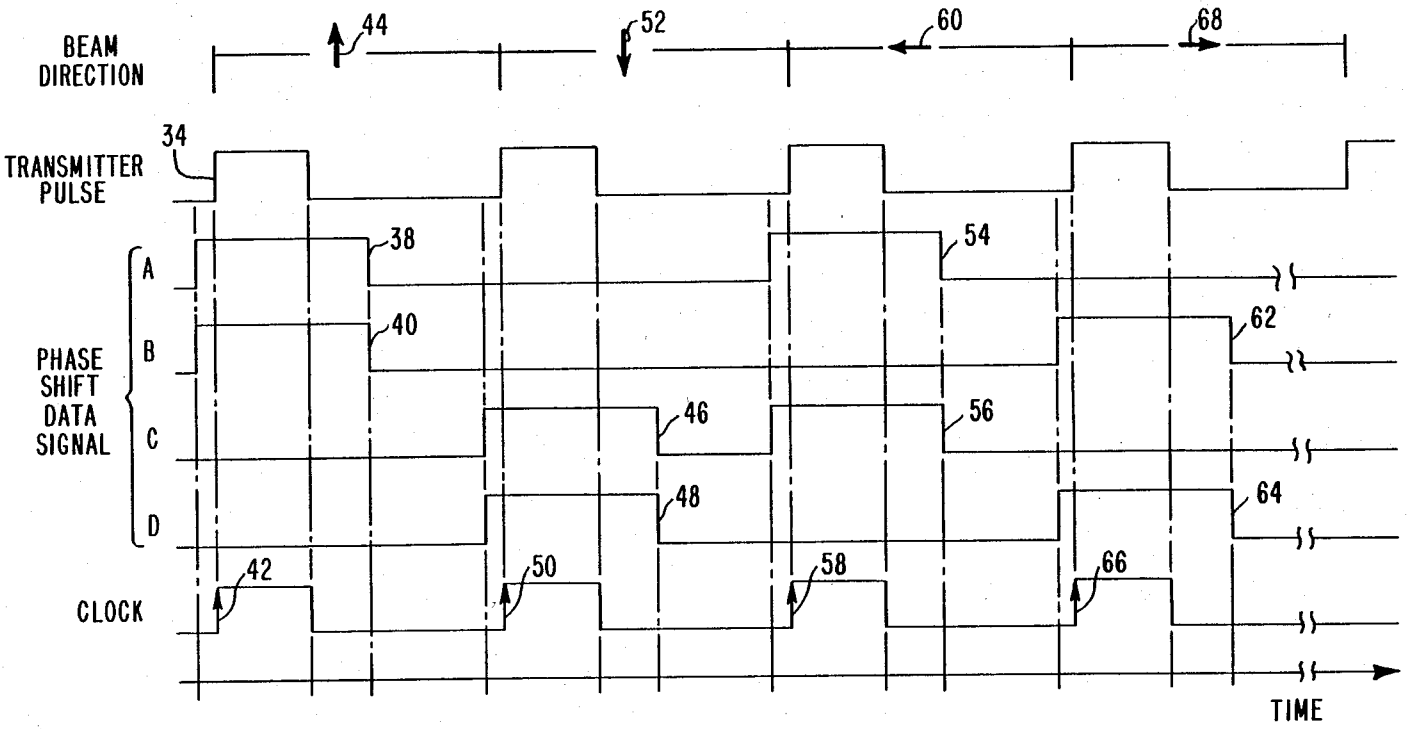
FIG. 2 is a waveform diagram illustrating the operation of the system shown in FIG. 1.

Operation of the system illustrated in FIG. 1 is illustrated by a waveform diagram in FIG. 2. In accordance with conventional practice, the receiver portion of the radar system 10 is disabled during and for short internals immediately proceeding and immediately following each transmitted pulse. Substantially all of the transmitted power is isolated from the diode switch by the circulator. However, due to the reflected power from the antenna 12 the diode switch may be subjected to substantial power levels. The phase shifter will be described in more detail later with reference to FIG. 6.

More specifically, the radar system 10 transmits a periodically pulsed microwave signal as illustrated at reference numeral 34 in FIG. 2. In response to timing signals from the radar system 10, not illustrated, the synchronizing circuit 24 generates a four-bit phase shift data signal with the four signals being labelled A–D in FIG. 3 to correspond to segments A–D of the antenna 12 illustrated in FIG. 1. Also, the synchronizing circuit 24 generates a clock signal which is synchronized with the periodically pulsed microwave signal 34.

More specifically, during the first pulse of the microwave signal 34, to bits the data signal, labeled A and B, are at a high level as illustrated at reference numerals 38 and 40. On the rising edge of the first pulse of the clock signal illustrated at reference numeral 42 the switching diodes associated with phase shifter circuits 22 and 16, coupled to segments A and B of the antenna 12, are turned on reducing the electrical length of the path between segments A and B by the antenna 12 and the radar system 10. This reduction in the electrical length of these paths introducing a phase shift in signals associated with segments A and B of antenna 12 relative to signals associated with segments C and D of this antenna. This causes the main lobe of the effective received beam of the antenna 12 to be shifted upward as illustrated by the upward pointing arrow 44 in FIG. 2.

During the second pulse of the pulsed microwave signal, two other bits of the data signal, labeled C and D are high as illustrated at reference numerals 46 and 48 while the data signals A and B are low. On the rising edge 50 of the second pulse of the clock signal the diode switch is associated with phase shifters 20 and 18 are turned on introducing a reduction in the electrical length of the signal paths between segments C and D of the antenna 12 and te radar system 10. This reduction in the length of the signal paths introduces a phase shift into the received signals associated with segments A and B of the antenna 12 relative to received signals associated with segments C and D of antenna 12. This causes the main lobe of the effective received beam to shift downward as illustrated by arrow 52 in FIG. 2. Similarly, during the third pulse of the signal transmitted by the radar transmitter 10, data signals A and C are high as illustrated at reference numerals 54 and 56, while signals B and D are low. On the rising edge 58 of the third pulse of the clock signal the diodes associated with phase shifters 22 and 20 are turned on reducing the electrical length of the path between segments A and C of the antenna 12 relative to the electrical length of the paths between segments B and D ofthe antenna 12 causing the main lobe of the received beam to be shifted to the left as illustrated by arrow 60 in FIG. 2. Finally, during the fourth pulse of the transmitted signal, data signals B and D are high as illustrated at reference numerals 62 and 64. On the rising edge 66 of the fourth pulse of the clock signal the diode switch is associated with segments B and D of the antenna 12 are turned on introducing a phase shift in the main lobe of the received beam, causing the effective beam to shift to the right as illustrated at reference numeral 68 of FIG. 2.

Figure 3:
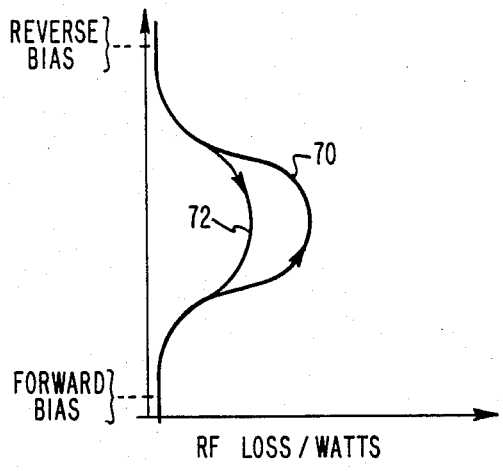
FIG. 3 is a diagram illustrating the loss of a PIN diode during switching.

FIG. 3 is a diagram illustrating the losses of a typical PIN diode as the diode is switched from forward to reverse and vice versa. This curve illustrates that as the diodes are switched from forward to reverse, as illustrated at reference numeral 70, the losses are considerably higher than when the diode is switched from reverse to forward as illustrated at reference numeral 72. Additionally, in some applications, these losses can be sufficiently high to cause destruction of the diode if the driver is not designed to rapidly switch between the forward and the reverse conditions.

Figure 4:
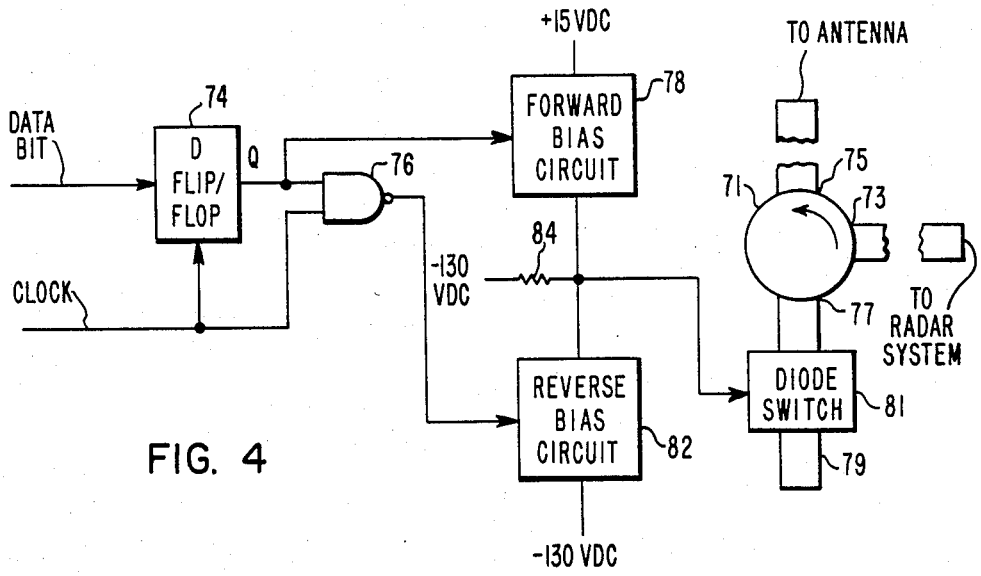
FIG. 4 is a block diagram of a diode driver circuit.

FIG. 4 is a drawing illustrating a diode switch driver and the microwave components comprising the invention. The diode switch driver which is utilized in the phase shifter which is the subject of this invention provides a circuit which independently controls the drive signals for both switching directions. The microwave portions of the phase shifter includes a conventional three port circulation 71. First and second ports 73 and 75 are respectively coupled to the radar system 10 and the antenna 12. A third port 77 is coupled to a short section of conventional waveguide 79 which is terminated is a short circuit. Intermediate between the third port 77 and the short circuit termination is a PIN diode switch 81 which is selectively turned on and off to provide at the switch a short circuit when the PIN diode is turned on and an open circuit when it is turned off thereby changing the electrical length of the path between the antenna 12 and the radar system 10.

Functionally, a data bit of the data signal (previously discussed) is coupled to the D input of a conventional D-type flip-flop 74. The clock signal (FIG. 2) is coupled to the clock input of flip-flop 74 and to one input of a NAND gate 76. The second input of the NAND gate 76 is coupled to the Q output of the D flip-flop 74. The Q output of the flip-flop 74 is also coupled to a forward bias current circuit 78 to generate at the output of this circuit sufficient current to turn on the PIN diode 80 when the Q output of the flip-flop 74 is a logic "0". This causes the diode to remain forward biased so long as the data input signal to the D flip-flop 74 remains in the logic "0" state.

When the data bit input to the D terminal of the flip-flop 74 switches to a logic "1", the next clock pulse will cause the Q output of the flip-flop 74 to go to a logic "1". The Q output of the flip-flop 74 and the clock signal form the inputs to the 2 input NAND gate 76. This produces a signal at the output of NAND gate 76 which drives a reverse bias circuit 82 to produce at the output of this circuit a high current pulse to quickly turn off the PIN diode when the data input is a logic "1". This current pulse lasts for the duration of the clock signal and is sufficient to turn off the PIN diode. Once the PIN diode has been turned off it is maintained in the reverse bias condition by coupling the positive terminal of the diode to a −130 volt signal by a resistor 84.

Figure 5:
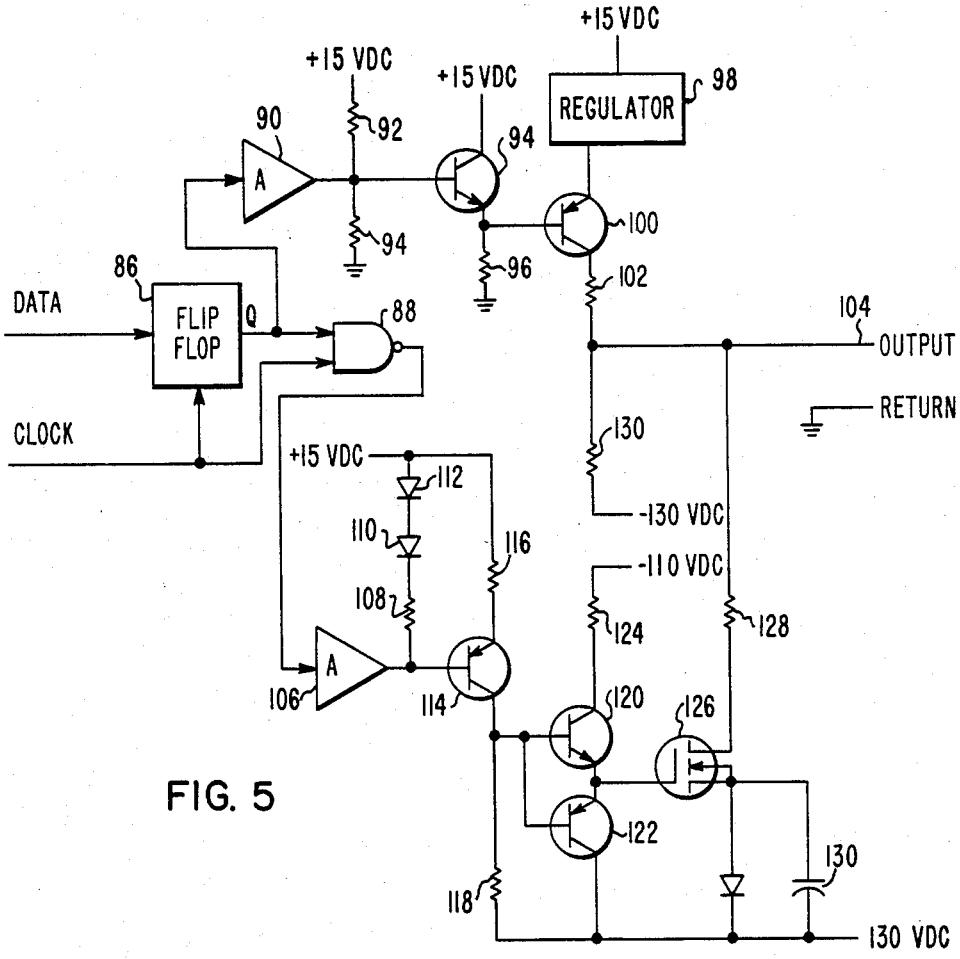
FIG. 5 is a schematic diagram of the diode driver circuit.

FIG. 5 is a detailed schematic diagram of the PIN diode driver circuit illustrated functionally in FIG. 4. More specifically, the data signal is coupled to the D input of flip-flop 86. The clock signal is coupled to the clock input of the flip-flop 86 and to one input of a two input NAND gate 88. The Q output of the flip-flop 86 is coupled to the input terminal of a noninverting amplifier 90. Two serial coupled resistors 92 and 94 form a divider between a +15 volt voltage source and ground with the open collector output of amplifier 90. The junction of these resistors is coupled to the base terminal of an NPN transistor 94. The collector of NPN transistor 94 is coupled to the +15 volt voltage source with the emitter of this transistor returned to ground through a resistor 96. A four volt voltage regulator 98 reduces the +15 volt source to 4 volts which is coupled to the emitter terminal of a PNP transistor 100. A second PNP transistor 100 has its collector coupled through a resistor 102 to the output terminal 104 to provide a bias current to turn on the PIN diode driven by the circuit.

When the data signal to the flip-flop 86 goes high, the Q output of the D flip-flop 86 and the clock signal coupled to the NAND gate 88 provide an input signal to a second non-inverting amplifier 106. The open collector output terminal of amplifier 106 is coupled through the serial combination of a resistor 108, diodes 110 and 112 to the +15 volt voltage supply. PNP transistor 114 has its emitter terminals coupled through a resistor 116 to the +15 volt supply. This prevents the transistor 114 from saturating. A resistor 118 is coupled between the collector of level shifting transistor 114 and a −130 volt voltage source. An NPN and a PNP transistor, 120 and 122, are connected in push-pull with the base of these two transistors connected to the collector of PNP transistor 114. A resistor 124 couples the collector of the PNP transistor 120 to a −110 volt source while the collector of the PNP transistor 122 is coupled to −130 volts. The common emitters of these two transistors is coupled to the gate of a high power field effect transistor 126. A high power diode coupled in parallel with a filter capacitor 130 provides a voltage source of approximately one volt to the source of field effect transistor 126. A resistor 128 couples the drain of field effect transistor 126 to the output terminal 104. When the data signal is a logic "0", the output of NAND gate 88 goes to a logic "1" for the duration of each pulse of the clock signal.

This causes the field effect transistor 126 to turn on for the duration of the clock pulse to provide a high current pulse to turn the diode off. Once the diode is off the diode is maintained in its off condition by a resistor 130 coupled to a −130 volt supply. The microwave components utilized by the phase shifter described above are commercially available. Suitable electronic components are available for use in the diode driver circuit. Therefore, no detailed description of the microwave or electronic components is provided.

I claim:

1. A phase shifter comprising:

(a) a multi-port circulator having at least first, second and third ports;

(b) reflective termination means coupled to at least one of said ports to reflect signals emerging from said at least one port to said at least one of said ports to introduce a predetermined phase shift in said signals emerging from said at least one port;

(c) a switching diode for introducing a predetermined change in said phase shift; and (d) a drive circuit comprising:

(1) a storage element responsive to a data signal and a clock signal;

(2) a forward bias circuit responsive to a first state of said storage element to provide a forward bias to said diode; and (3) a reverse bias circuit responsive to a second state of said storage element and a clock signal to provide a reverse bias current pulse and a sustaining cutoff voltage bias to said diode.

2. A phase shifter in accordance with claim 1 wherein said switching diode comprises a PIN diode coupled across a waveguide comprising a portion of said multiport circulator.

* * * * *